US007954170B2

(12) United States Patent
Höfer et al.

(10) Patent No.: US 7,954,170 B2
(45) Date of Patent: Jun. 7, 2011

(54) ANTI-TRANSPIRATION INSERT

(75) Inventors: Stephanie Höfer, Dinslaken (DE); Gelnaz Safina-Wright, Niestetal (DE)

(73) Assignee: BetaLife GmbH, Oberhausen (DE)

( * ) Notice: Subject to any disclaimer, the term of this patent is extended or adjusted under 35 U.S.C. 154(b) by 0 days.

(21) Appl. No.: 12/664,260

(22) PCT Filed: Jun. 6, 2008

(86) PCT No.: PCT/DE2008/000943

§ 371 (c)(1),
(2), (4) Date: Dec. 11, 2009

(87) PCT Pub. No.: WO2008/151607

PCT Pub. Date: Dec. 18, 2008

(65) Prior Publication Data

US 2010/0180357 A1 Jul. 22, 2010

(30) Foreign Application Priority Data

Jun. 13, 2007 (DE) ..... 20 2007 008 283 U

(51) Int. Cl.
*A41D 27/12* (2006.01)

(52) U.S. Cl. ..... 2/53

(58) Field of Classification Search ..... 2/46, 267, 2/231, 406, 53–58, 268, 62, 104, 466, 463, 2/459, 20, 24, 60; 604/385.201; 450/37, 450/39, 55, 56, 57
See application file for complete search history.

(56) References Cited

U.S. PATENT DOCUMENTS

| | | | | | |
|---|---|---|---|---|---|
| 235,888 | A | * | 12/1880 | Mandel | 2/231 |
| 338,744 | A | * | 3/1886 | Hiscott | 2/53 |
| 2,269,365 | A | * | 1/1942 | Fowler | 2/53 |
| 2,535,864 | A | * | 12/1950 | Plehn | 450/55 |
| 3,145,391 | A | * | 8/1964 | Tyrrell, Jr. | 2/56 |
| 3,156,924 | A | * | 11/1964 | Wonacott | 2/53 |
| 3,345,643 | A | * | 10/1967 | Bradley | 2/53 |
| 3,884,234 | A | * | 5/1975 | Taylor | 604/365 |
| 4,485,492 | A | * | 12/1984 | Sneider | 2/56 |
| 4,773,905 | A | * | 9/1988 | Molee et al. | 604/378 |
| 5,570,471 | A | * | 11/1996 | Krawchuk | 2/53 |
| 5,790,982 | A | * | 8/1998 | Boutboul et al. | 2/53 |
| 5,864,889 | A | * | 2/1999 | Suffern | 2/247 |
| 6,210,385 | B1 | * | 4/2001 | Mizutani | 604/385.01 |
| 6,516,541 | B2 | * | 2/2003 | Cagner | 36/102 |
| 6,760,920 | B1 | | 7/2004 | Kadymir et al. | |
| 2006/0150294 | A1 | | 7/2006 | Yanamadala | |

FOREIGN PATENT DOCUMENTS

| | | |
|---|---|---|
| AT | 006 064 U1 | 4/2003 |
| FR | 2 845 870 A1 | 4/2004 |
| JP | 08-92807 A | 4/1996 |

OTHER PUBLICATIONS

The International Bureau of WIPO, Translation of the International Preliminary Report on Patentability mailed Jan. 21, 2010.
International Search Report: PCT/DE2008/000943.

* cited by examiner

*Primary Examiner* — Amy B Vanatta
(74) *Attorney, Agent, or Firm* — Ladas & Parry LLP

(57) ABSTRACT

An anti-transpiration insert is disclosed. The anti-transpiration insert includes a target bending line extending from a first side to a second side of the anti-transpiration insert, wherein that the target bending line is configured in an arched manner.

6 Claims, 4 Drawing Sheets

ANTI-TRANSPIRATION INSERT

CROSS REFERENCE TO RELATED APPLICATION

This application is a national stage application of International Application No. PCT/DE2008/000943, filed Jun. 6, 2008, which claims priority to German Patent Application No. 20 2007 008 283.5, filed Jun. 13, 2007, each of which is hereby incorporated in its entirety herein by reference thereto.

FIELD OF THE DISCLOSURE

The present disclosure relates generally to an anti-transpiration insert.

BACKGROUND OF RELATED ART

Anti-transpiration inserts are normally used under the armpit of individuals in order to absorb the sweat occurring there so that it does not stain the clothes. Such an anti-transpiration insert is for example known from US 2006/0150294 A1. This anti-transpiration insert comprises a lower part and an upper part which are each realized substantially in oval shape. At the point of contact between the upper and the lower part a straight perforation line is provided which is intended to permit bending of the two parts relative to each other. This presents the advantage that the anti-transpiration insert folded once thus can be simply inserted into the piece of clothing with the anti-transpiration insert resting on the upper edge of the sleeve or the piece of clothing along the length of the perforated line. After folding of this anti-transpiration insert, it is likewise formed extensively and must be bent in accordance with the sleeve. During this, it may happen that the anti-transpiration insert rips open or crumples undesirably since due to the thickness of the material the inner part has to cover a smaller radius than the outer part so that tension occurs between the two parts. Also, such an anti-transpiration insert is somewhat cumbersome or unwieldy in the armpit and thus is felt to be bothersome.

DETAILED DESCRIPTION

It is therefore the objective of the present disclosure to provide an anti-transpiration insert of the type mentioned above by means of which the folding and insertion into a piece of clothing can easily be made.

The following description of the disclosed embodiment is not intended to limit the scope of the disclosure to the precise form or forms detailed herein. Instead the following description is intended to be illustrative of the principles of the disclosure so that others may follow its teachings.

Figure 1A:
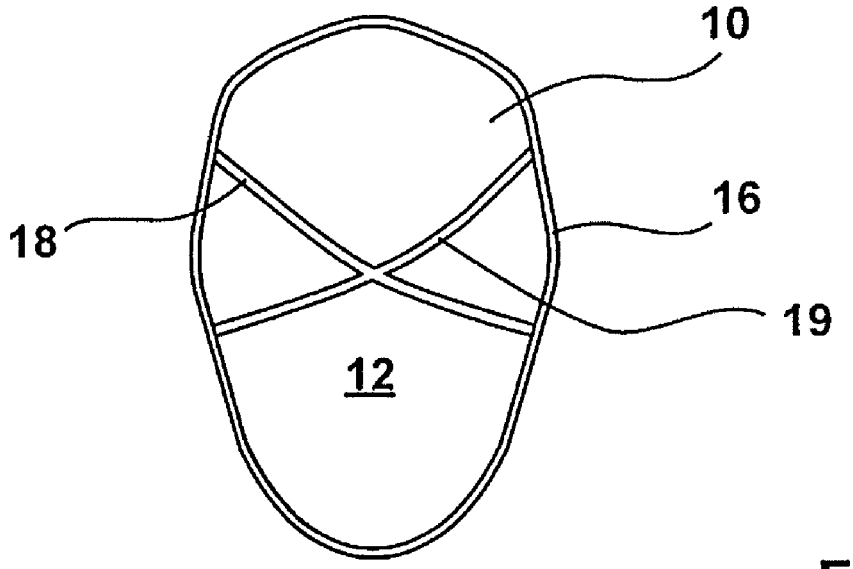
FIG. 1*a* is a first embodiment of an anti-transpiration insert according to the disclosure in non-bent state.
Figure 1B:
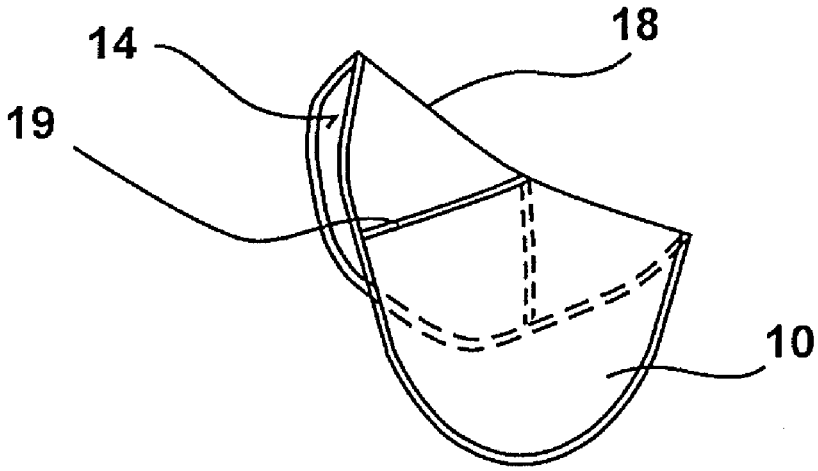
FIG. 1*b* is the anti-transpiration insert according to FIG. 1*a* in a bent state.

In FIGS. 1*a* and 1*b* an anti-transpiration insert 10 is shown having a surface permeable to moisture 12 and a bottom side impermeable to moisture 14 with an absorbent core made from a hygroscopic and a moisture absorbing material being used between the upper layer 12 and the lower layer 14. This anti-transpiration insert 10 is provided with a circumferential edge 16 on which the lower layer 14 is joined with the upper layer 12 so that the absorbent core is enclosed in it. Moreover the anti-transpiration insert 10 is provided with two target bending lines 18, 20 alongside which the anti-transpiration insert 10 can be folded. Each target bending line 18, 20 is configured in an arched manner with the target bending line 18 extending from top left obliquely to bottom right, and the target bending line 20 extending from top right obliquely to bottom left. In approximately the middle of the anti-transpiration insert 10 the target bending lines 18 and 20 cross. In this embodiment the target bending line 18, 20 is formed such that alongside this target bending line 18, 20 the upper face 12 is directly connected to the lower face 14 without an absorbent core being present between the upper face 12 and the lower face 14.

As can particularly be taken from FIG. 1*b*, the anti-transpiration insert 10 in its folded state is curved virtually three-dimensionally due to the arched configuration target bending line 18. This curvature in turn has the effect that the anti-transpiration insert 10 can easily be inserted for example into the sleeve of a coat and is held in position there due to the clamping effect of the folded anti-transpiration insert 10.

In FIG. 1*b* the anti-transpiration insert is shown in folded state alongside the target bending line 18. In an embodiment (not shown here) it is, however, also possible to fold the anti-transpiration insert 10 alongside the target bending line 20. In folded state, the anti-transpiration inserts 10 are then curved mirror-invertedly so that both anti-transpiration inserts 10 can easily be inserted into the right and left sleeve of the coat respectively. In that case the anti-transpiration insert 10 has to be folded such that the upper layer permeable to moisture 12 faces towards the skin of the individual wearing it, whereas the lower layer impermeable to moisture 14 faces towards the piece of clothing.

Figure 2:
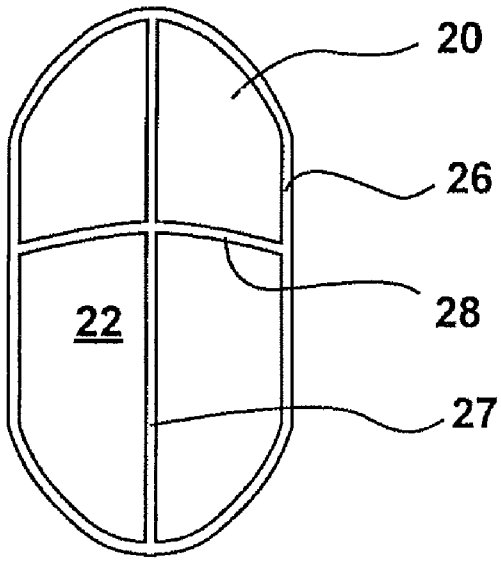
FIG. 2 is a second embodiment of an anti-transpiration insert according to the disclosure in non-bent state.

The second embodiment illustrated in FIG. 2 shows an anti-transpiration insert 20 likewise with an upper layer 22 and a lower layer (not shown) between which an absorbent core is formed. As in the first embodiment, the anti-transpiration insert has a circumferential edge 26 also in that case, where upper layer 22 and lower layer meet and are connected to each other so that the absorbent core is enclosed within. The anti-transpiration insert 20 moreover has a target bending line 28 extending substantially horizontally from right to left which is configured here in an arched manner towards the top. Moreover a parting line 27 is provided in the anti-transpiration insert 20 which is disposed substantially vertically to the target bending line 28. This target bending line 28 is disposed slightly above the center so that the anti-transpiration insert 20 defines a slightly larger lower element and a slightly smaller upper element.

Similar to FIG. 1*b* also in this case the anti-transpiration insert 20 is folded such that the slightly smaller upper element is bent backwards so that alongside the target bending line 28 a separation between the upper and the lower element occurs. In this, the upper surface 22 faces towards the skin of the individual wearing it.

By the arched configuration of the target bending line 28 a curvature of the folded anti-transpiration insert occurs similar to the embodiment shown in FIG. 1*b*. The effect of the parting line 27 of the anti-transpiration insert 20 is that after folding of the anti-transpiration insert 20 a curvature without tension occurs. Another advantage is that this anti-transpiration insert 20, if required, may also be modified alongside the parting line 27 extending substantially vertically so that adjustment of the anti-transpiration insert 20 to the actual situation on the piece of clothing can easily occur without the need of making excessive use of the anti-transpiration insert 20 here.

Figure 3A:
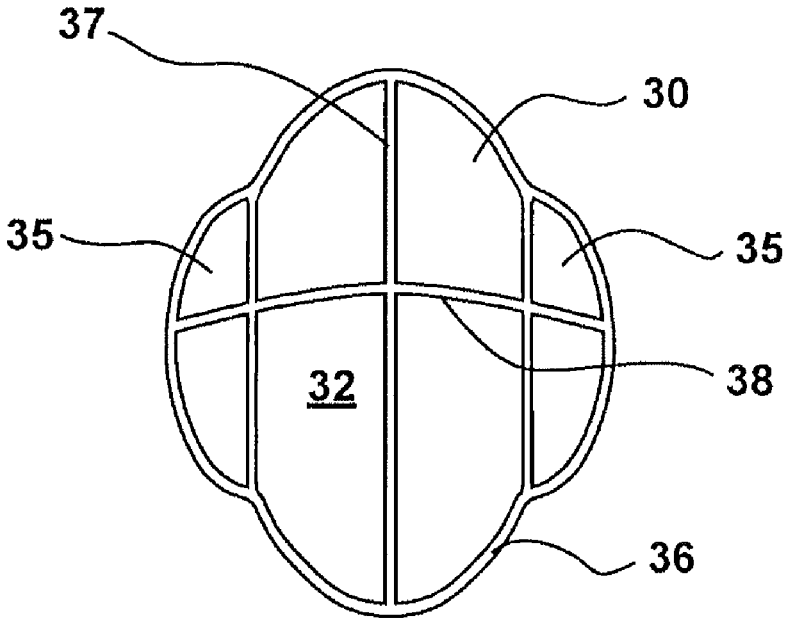
FIG. 3*a* is a third embodiment of an anti-transpiration insert according to the disclosure in non-bent state.
Figure 3B:
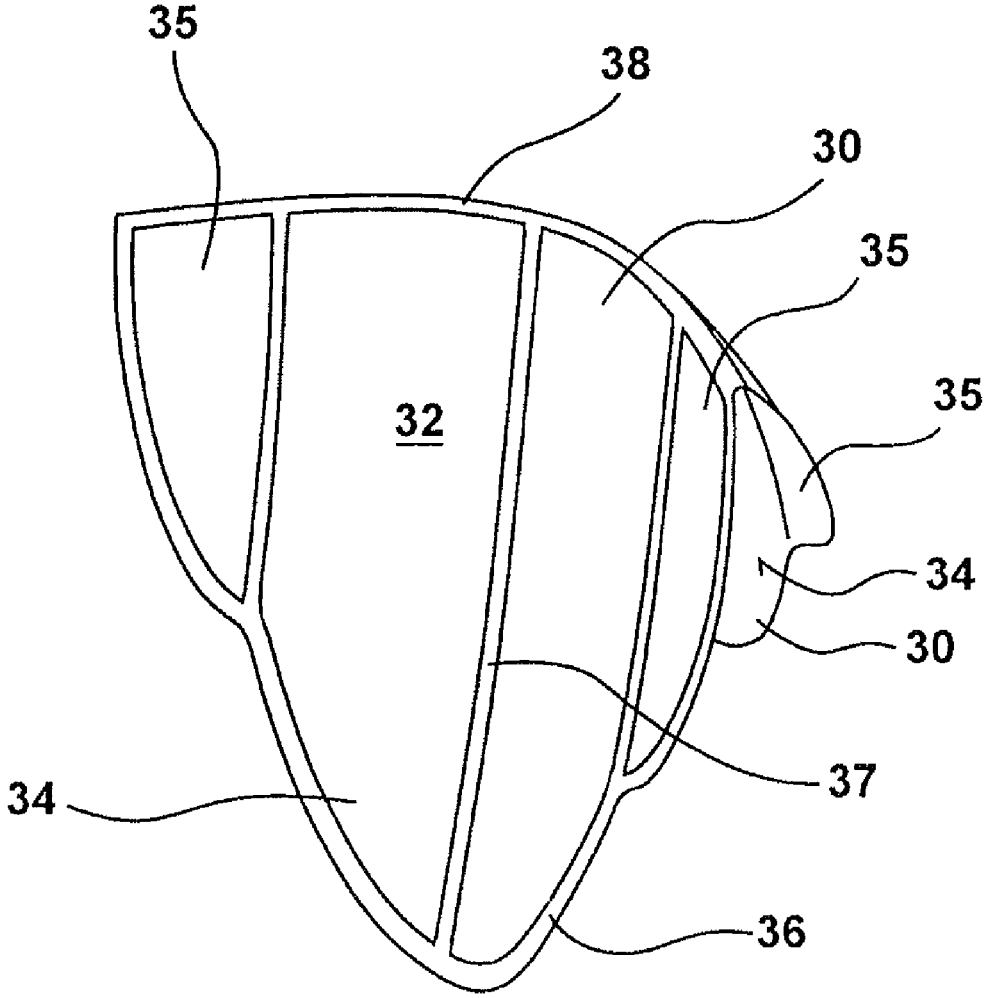
FIG. 3*b* is the anti-transpiration insert according to FIG. 3*a* in a bent state.

In FIGS. 3*a* and 3*b* a third embodiment of an anti-transpiration insert 30 according to the disclosure is illustrated. As on the other embodiments, the anti-transpiration insert 30 both from its upper face 32 and from its lower face 34 substantially looks the same. By its outer design the anti-transpiration insert 30 substantially corresponds to the anti-transpiration insert 20 shown in FIG. 2 but it comprises in addition small wings 35 on the left side and on the right side. Otherwise the design of the anti-transpiration insert 30 substantially corresponds to that of anti-transpiration insert 20.

As can clearly be taken from FIG. 3*a* and FIG. 2, anti-transpiration insert 30 is of the same height than anti-transpiration insert 20 but it is wider than the latter. Whereas the anti-transpiration insert 20 is substantially ovally shaped and flattened straight on its longitudinal sides, there are still wings 35 adjacent to the flattened longitudinal sides of anti-transpiration insert 30 with the target bending line 38 extending from the outer left edge to the outer right edge of the anti-transpiration insert 30, thus crossing not only the center portion but also the wing 35 and being uniformly configured in an arched manner over the entire length. As is the case for the other embodiments, the upper layer 32 and the lower layer 34 are connected to each other on the circumferential edge 36 in the same way as in the area of the parting line 37 and the target bending line 38. Also between the wings 35 and the center portion the upper layer 32 and the lower layer 34 are joined directly.

The anti-transpiration insert 30 is especially used in the case of larger pieces of clothing since due to the wings 35 it has a wider configuration. Due to the target bending line 38 configured in an arched manner here as well, a curvature is produced in the folded anti-transpiration insert 30, as can be seen in FIG. 3*b*. In order to increase the curvature further and/or adjust it to the individual conditions, the anti-transpiration insert 30 can be curved further by means of the parting line 37. Due to the parting line between the wing 35 and the center portion, a further curvature is still possible so that also the wings 35 can be bent independent of the center portion. As a result, an individual adjustment of the anti-transpiration insert 30 to the conditions on the piece of clothing can be made. The anti-transpiration insert 40 illustrated in FIG. 4 substantially corresponds to the anti-transpiration insert 20 in FIG. 2, and differs only by a folding line 41 disposed vertically to the parting line 47. This folding line 41 is here—as in the other embodiments—formed by the fact that the upper layer 42 is here directly connected to the lower layer 44 (not shown) without a core being defined in-between. Otherwise, this anti-transpiration insert 40 likewise has a target bending line 48 configured in an arched manner and extending substantially horizontally.

In folded state the anti-transpiration insert 40 is curved as in the other embodiments, and can therefore also be well inserted into a sleeve of a piece of clothing. When doing this, the part of the anti-transpiration insert 40 provided with the folding line 41 is inserted into the sleeve, while the other part is fitted closely to the body of the individual wearing it. In order that the anti-transpiration insert 40 can follow well the contour of the sleeve, this folding line 41 is provided so that the smaller part above the folding line 41 can move again without difficulties relative to the bent part of the anti-transpiration insert 40, and thus can follow, if necessary, the shape of the sleeve.

Another advantage of the folding line is that the upper part of the anti-transpiration insert 40 can easily be cut off as a result, in order to adjust the size of the anti-transpiration insert 40 to the size of the sleeve so that not part of the anti-transpiration insert 40 projects from the sleeve. This is possible, for example, by the fact that in the area of the folding line 41 the upper layer 42 is connected directly to the lower layer so that the core material located in the anti-transpiration insert cannot come out.

Figure 4:
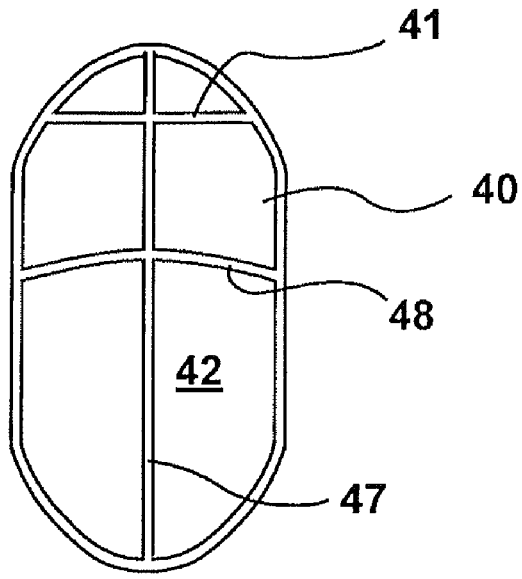
FIG. 4 is a fourth embodiment of an anti-transpiration insert according to the disclosure in non-bent state.
Figure 5:
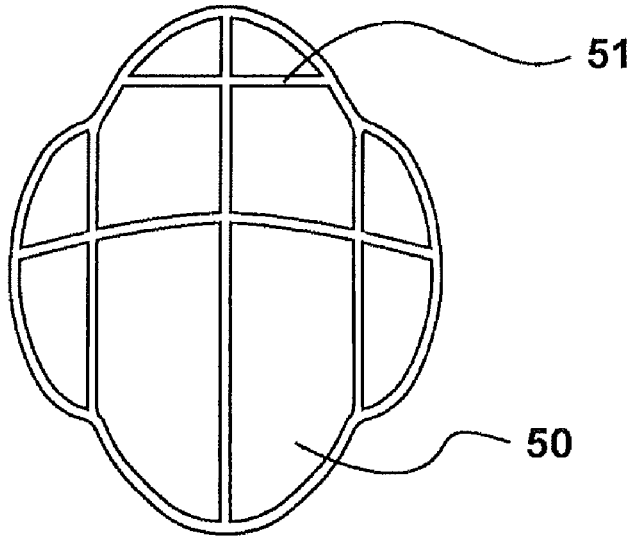
FIG. 5 is a fifth embodiment of an anti-transpiration insert according to the disclosure in non-bent state.

The anti-transpiration insert shown in FIG. 5 substantially corresponds to the anti-transpiration insert 30 shown in FIG. 3*a* and FIG. 3*b* but comprises one folding line 51 in addition as has already been described with respect to anti-transpiration insert 40 according to FIG. 4.

As a technical solution of above-referenced objective, an anti-transpiration insert is proposed according to the above disclosure. An anti-transpiration insert formed according to these technical teachings has the advantage that during bending of the anti-transpiration insert, the target bending line configured in an arched manner urges the two parts of the anti-transpiration insert virtually automatically into an arched position. This means that the folded anti-transpiration insert is no longer oriented planely but stands up three-dimensionally. By this, the folded anti-transpiration insert can already substantially reproduce the arched configuration of the sleeve or the upper part of the person's body, and can thus be attached to the piece of clothing more easily.

The amount of arching of the target bending line directly influences the amount of curvature of the folded anti-transpiration insert so that it is possible to influence subsequent curvature by the arching of the target bending line. This has the advantage that the anti-transpiration insert can be conformed to the piece of clothing to be expected.

In one embodiment, the target bending line is substantially disposed along the center of the anti-transpiration insert. This has the advantage that the two parts of the anti-transpiration insert are substantially of same size.

In another embodiment, the target bending line may also extend eccentrically with the consequence that the folded anti-transpiration insert possesses a large part and a small part. Such eccentrically folded anti-transpiration inserts are often used for pieces of clothing, which are worn on the body, since here on the body side a far larger sweat volume occurs than on the side of the arm.

In another embodiment, the target bending line extends obliquely. As a result, the two parts of the anti-transpiration insert are also folded obliquely, which is especially advantageous when being inserted into sleeves of a blouson or coat, since an optimum fit of the anti-transpiration insert is achieved here.

In a further embodiment, two target bending lines extending obliquely are provided which cross in the middle. This has the advantage that one and the same anti-transpiration insert can be folded optionally for the right sleeve or for the left sleeve of a piece of clothing. In still another embodiment substantially perpendicular to the target bending line a parting line is formed. This has the advantage that the anti-transpiration insert curved after folding can be folded further alongside the parting line, if this is required by the sleeve of the piece of clothing.

In still another embodiment, a folding line is formed in the upper area perpendicular to the parting line. Hereby, the upper part of the anti-transpiration insert can be bent further, if this is required by the piece of clothing. Another advantage lies in the fact that the upper part of the anti-transpiration insert can be easily severed alongside the folding line. In this connection, the folding line has the effect that the core of the anti-transpiration insert is not lost, because upper layer and lower layer are connected to each other also alongside the folding line, thus closing the anti-transpiration insert, even if the upper part is severed. Severing of the upper part is important, for example, if the anti-transpiration insert is supposed to be used in a short-sleeved shirt or blouse, since otherwise this upper part would stick out from the piece of clothing.

In a further embodiment, the target bending line is formed as a tapering or as a perforation. With such a tapering it becomes easily possible to fold the anti-transpiration insert. The same applies to the perforation since here as well weakening of the material occurs. Further advantages of the anti-transpiration insert according to the disclosure result from the attached drawings and the embodiments described below. Likewise the above-mentioned and still further detailed features can be used individually or in any combinations with each other. The embodiments mentioned are non-limiting examples.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

LIST OF REFERENCE NUMERALS

| | |
|---|---|
| 10, 20, 30, 40, 50 | anti-transpiration insert |
| 41, 51 | folding line |
| 12, 22, 32, 42 | upper layer |
| 14, 34, | lower layer |
| 35 | wing |
| 16, 26, 36 | edge |

-continued

| | |
|---|---|
| 27, 37, 47 | parting line |
| 18, 28, 38, 48, 58 | target bending line |
| 19 | target bending line |

We claim:

1. An anti-transpiration insert for mounting on clothes comprising:

a target bending line extending from a first side to a second side of the anti-transpiration insert, wherein the anti-transpiration insert is foldable along the target bending line, wherein the target bending line is configured in an arched manner such that the anti-transpiration insert raises three-dimensionally when folded, and wherein the target bending line extends obliquely.

2. An anti-transpiration insert according to claim 1, wherein the target bending line extends obliquely from the upper left side to the bottom of the right side, or in reverse.

3. An anti-transpiration insert according to claim 1, further comprising a second target bending line, wherein the two target bending lines extend obliquely and intersect one another.

4. An anti-transpiration insert according to claim 3, wherein the two target bending lines intersect in substantially the middle of the insert.

5. An anti-transpiration insert according to claim 1, wherein the target bending line is formed as at least one of a tapering or as a perforation.

6. An anti-transpiration insert according to claim 1, wherein the target bending line is arranged eccentrically.

* * * * *